United States Patent [19]

Pearson

[11] 4,109,482

[45] Aug. 29, 1978

[54] FAN CONTROL CIRCUIT FOR AIR CONDITIONER

[75] Inventor: Samuel Joseph Pearson, St. Joseph, Mich.

[73] Assignee: Whirlpool Corporation, Benton Harbor, Mich.

[21] Appl. No.: 747,668

[22] Filed: Dec. 6, 1976

[51] Int. Cl.[2] ..... F25D 17/06

[52] U.S. Cl. ..... 62/180; 62/213

[58] Field of Search ..... 62/179, 180, 186, 229, 62/213, 262

[56] References Cited

U.S. PATENT DOCUMENTS

| | | | |
|---|---|---|---|
| 2,320,432 | 6/1943 | Henney | 62/180 |
| 3,070,972 | 1/1963 | Atchison | 62/183 X |
| 3,373,577 | 3/1968 | Bohman | 62/186 X |
| 3,635,044 | 1/1972 | Heth | 62/180 X |

*Primary Examiner*—William E. Wayner
*Attorney, Agent, or Firm*—Edward A. Ketterer, III; James S. Nettleton

[57] ABSTRACT

A control circuit for a room air conditioner includes two temperature sensing devices and an associated switch network which operate to de-energize the evaporator fan upon de-energization of the compressor but, as the temperature of the room air subsequently rises, cause the evaporator fan to be energized prior to re-energization of the compressor. The evaporator housing and temperature sensing devices are arranged such that during operation of the evaporator fan one of the devices senses the temperature of air entering the evaporator while the other senses the temperature of air leaving the evaporator, but during periods when the evaporator fan is off the device which formely sensed the temperature of air leaving the evaporator operates to sense the temperature of room air.

11 Claims, 3 Drawing Figures

Fig. 1
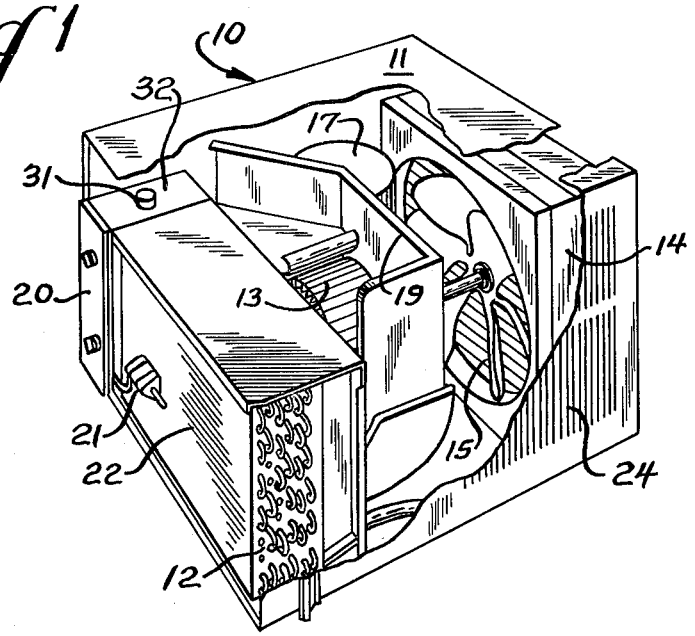
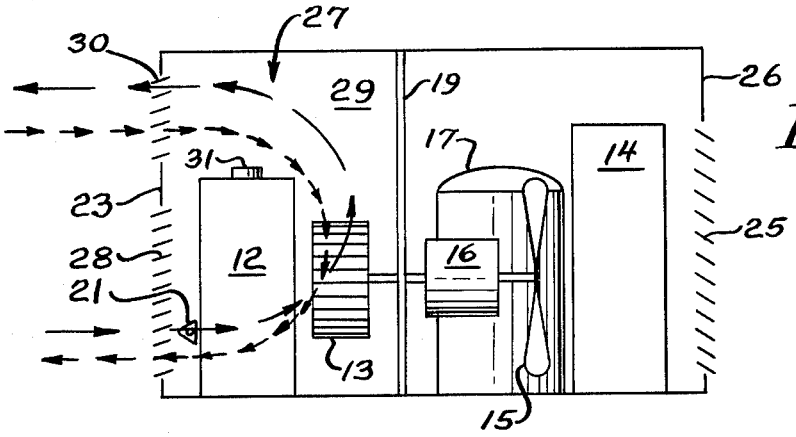
Fig. 2
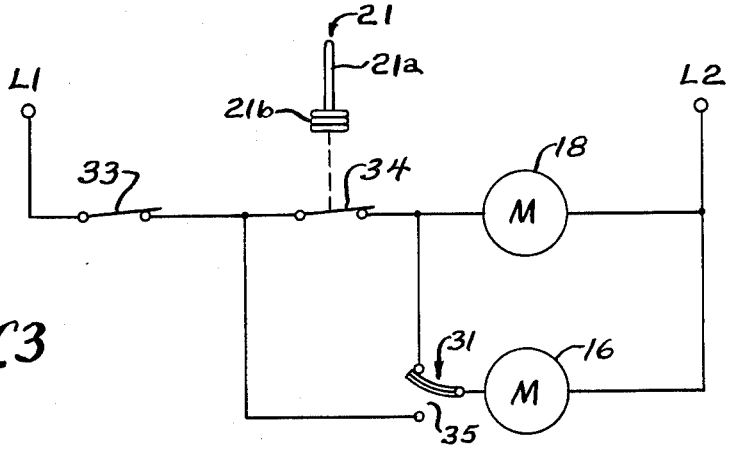
Fig. 3

FAN CONTROL CIRCUIT FOR AIR CONDITIONER

BACKGROUND OF THE INVENTION

1. Field of the Invention

This invention pertains to control circuits for air conditioners, and in particular to a temperature responsive control circuit which separately controls the energization of the compressor and fan in such an apparatus.

2. Description of the Prior Art

It has been recognized for some time that the energy consumed by an air conditioning apparatus, such as a room air conditioner, can be reduced if the evaporator fan is cycled on and off concurrently with the compressor. It has also been recognized that such concurrent cycling of the evaporator fan and compressor generally causes greater fluctuation in the room air temperature maintained by the air conditioner. This is due to the fact that air conditioners are commonly provided with a single temperature sensing device, which device is often located adjacent or in thermal association with the evaporator. When such a device is used to control both the fan and the compressor, poor temperature sensing results during periods when the fan is off because room air is no longer circulated over the sensing device and, because of its proximity to the evaporator, the temperature sensed by the device is likely to be considerably lower than the actual temperature of the room air.

U.S. Pat. No. 3,635,044, issued to G. A. Heth and assigned to the assignee of the present invention, discloses the use of a separate timer motor and switch which periodically energize the evaporator fan during periods when the fan and compressor are cycled off, thereby causing room air to flow over the temperature sensing device.

U.S. Pat. No. 3,373,577, issued to R. H. Bohman, discloses an air conditioner control in which a single thermostatic device sequentially operates a pair of switches such that the fan motor is de-energized and energized at a temperature below that at which the compressor is de-energized and energized. This arrangement will cause room air to be circulated over the thermostatic device prior to energization of the compressor, but only when the sensed temperature of the sensing device reaches a predetermined level. Since the single temperature sensing device used is in thermal association with the evaporator, the sensed temperature will not correspond closely with the room air temperature until such time as the fan is energized. Thus, even though the fan is energized at a sensed temperature below that required to energize the compressor, the temperature sensed with the fan off is not truly indicative of the room air temperature. Accordingly, greater fluctuations in room air temperature will occur than would be experienced if the fan were operated continuously.

U.S. Pat. No. 3,070,972, issued to L. W. Atchison, discloses an air conditioner control in which a single temperature responsive device operates two sets of switch contacts such that the evaporator fan is switched to a low speed operation when the compressor is switched off. Such an arrangement should provide good temperature sensing of the room air but does not minimize the noise or power consumption of the air conditioner unit, as is the case with the present invention.

U.S. Pat. No. 2,044,538, issued to M. F. May, discloses a control for a central heating and cooling system which includes two thermostatic devices operating at different temperatures to control different components within the air conditioning system.

SUMMARY OF THE INVENTION

The invention comprehends an improved control circuit for an air conditioning apparatus, such as a room air conditioner, the control being designed to provide cycled operation of the evaporator fan to realize economy of operation while additionally providing good sensing of the room air temperature during periods when the fan is off. This is accomplished by providing, in addition to the temperature sensing device which is conventionally employed to control energization of the compressor, a second temperature sensing device which is arranged to sense room air temperature during periods when the fan is off. The second sensing device operates to energize the fan when the sensed temperature rises above a predetermined level, which temperature may advantageously be several degrees lower than that at which the first sensing device operates to energize the compressor. Upon energization of the fan, room air is drawn over the first temperature sensing device and, if the room air has reached a sufficiently high temperature, the compressor will be energized. Otherwise, the fan will continue to operate alone until the room air temperature increases sufficiently to energize the compressor or decreases sufficiently to deenergize the fan.

It has been found that certain arrangements of the evaporator and its associated air passages cause convection currents of air to be set up during periods when the fan is off which circulate room air through the air conditioner in a direction opposite from that which it takes when the fan is on, thereby drawing room air in the outlet of the air conditioner and causing it to exit through the inlet. The preferred embodiment of the present invention takes advantage of this phenomenon by locating the second temperature sensing means at a point which is downstream of the evaporator during fan operation but upstream of the evaporator during periods of reverse convective air flow, thus enabling the sensing means to respond accurately to the room air temperature during periods when the fan is off.

More specifically, in the preferred embodiment an air conditioner is provided with a generally vertical air flow path, an evaporator defining an air inlet, means defining an air outlet above said inlet, first temperature sensing means adjacent said inlet for sensing the temperature of air entering the evaporator during periods when the fan is operating, a second temperature sensing means located in the evaporator outlet area, a first switch operated by said first temperature responsive means for connecting the compressor to a source of power and a second switch operated by said second temperature sensing means for alternately connecting said fan to the power source in parallel with the first switch means for sensed temperatures above said predetermined temperature and in series with said first switch means for sensed temperatures below said predetermined temperature.

BRIEF DESCRIPTION OF THE DRAWINGS

Other features and advantages of the invention will be apparent from the following description, taken in connection with the accompanying drawings wherein:

FIG. 1 is a perspective view of an air conditioner with portions of the outer cabinet broken away to facilitate illustration of the invention;

FIG. 2 is a schematic side view of an air conditioner embodying the present invention; and FIG. 3 is a schematic circuit diagram of an air conditioner control embodying the invention.

DESCRIPTION OF THE PREFERRED EMBODIMENT

Referring to FIG. 1, a room air conditioning apparatus generally designated 10 is shown to include an outer cabinet 11 which is partially broken away to expose the internal components of the air conditioning apparatus. The components include an evaporator 12, an evaporator fan or blower 13, a condenser 14 and a condenser fan 15. The air conditioner further includes a motor 16 which drives both the evaporator fan 13 and the condenser fan 15, as illustrated in FIG. 2. A compressor 17 is driven by a compressor motor 18 (FIG. 3). A dividing wall 19 separates the evaporator and condenser portions of the apparatus.

A control housing 20 is positioned beside the evaporator, as shown in FIG. 1, and contains a portion of the electrical control circuitry which operates the air conditioning apparatus. A temperature sensing means 21 is positioned adjacent the front surface 22 of evaporator 12. The temperature sensing means 21 may comprise a temperature sensing bulb enclosed in a block of material having a preselected limited thermal conductivity and mounted so as to be in thermal transfer engagement with the front surface 22 of evaporator 12. The operation and construction of such a temperature sensing device are disclosed in U.S. Pat. No. 3,158,005, issued to L. J. Jungemann and assigned to the assignee of the present invention.

The air conditioner is provided with a decorative front panel 23 through which air may freely pass. During operation of the evaporator fan 13, air is drawn through the lower inlet portion 28 of front panel 23, through evaporator 12 to the fan 13, from which it exits upwardly and outwardly over the top of evaporator 12 and through an outlet portion 30 of front panel 23. This flow is illustrated by the solid arrows in FIG. 2.

Concurrently with operation of the evaporator fan 13, condenser fan 15 operates to draw air into the unit through louvers 24 in the sides of the exterior cabinet 11. The air is then caused to flow through condenser 14 and then outwardly through an appropriate grille or louvered area 25 in the rear cabinet wall 26.

The air conditioner apparatus and its operation as described thus far are conventional and well known in the art. The present invention is concerned with the provision of additional temperature sensing means and an associated switching circuit which permits the fan motor 16 to be cycled on and off as the function of the energization of the compressor 17 while still providing good sensing of the room air temperature, as will be described below.

It has been found that a reverse convective air flow is established through the evaporator compartment of the air conditioner during periods when the motor 16 for evaporator fan 13 has been cycled off. The general path taken by this convective flow is illustrated by the dotted lines in FIG. 2, the normal air flow during operation of the fan being illustrated by the dashed lines.

The reason the reverse convective flow takes place can be understood by considering the arrangement of the evaporator housing, generally designated 27, of the air conditioner. As can be seen with reference to FIGS. 1 and 2, the evaporator 12 is vertically disposed and housed within the air conditioner such that when the fan 13 is operating air is drawn into evaporator 12 after passing through an inlet portion 28 of the decorative front panel 23. After passing through the evaporator, the air is forced upwardly into a discharge plenum area 29 and then outwardly into the room through an outlet portion 30 of panel 23. Thus, due to the position of evaporator 12, the location of fan 13 and the space defined by the walls of the outer cabinet 11 and divider wall 19, air flowing through evaporator housing 27 of the air conditioner must necessarily follow a generally vertical path. During periods when evaporator 13 has cycled off, the evaporator 12 remains quite cold, thereby cooling air in its vicinity. The cooled air moves outward by gravity through portion 28 of panel 23, causing room air to be drawn into the evaporator housing through portion 30 of front panel 23. Room air thus drawn into the evaporator housing 27 will flow through the discharge plenum 29, downward through fan 13, and through the evaporator 12 where the air is slightly chilled, before it re-enters the room via portion 28 of front panel 23.

This reverse convective air flow takes place for a considerable period of time following de-energization of the fan 13, and will continue as long as the evaporator 12 remains cooler than the room air.

Evaporators in room air conditioners are commonly operated at a surface temperature slightly above 32° F., for example at a temperature 35° F., which is well below the temperature of the room air. It has been found that the evaporator remains sufficiently below the temperature of the room air for a period which is long enough to encompass the time intervals typically experienced between de-energized and subsequent re-energization of the evaporator fan 13.

As will be appreciated with reference to the FIGS. 1 and 2, the temperature of room air entering the evaporator housing 27 during periods of reverse convective air flow does not change substantially until it flows downward into contact with the evaporator 12. Accordingly, the temperature of the air in the discharge plenum 29 is substantially the same as that of the room air. The present invention takes advantage of this fact by employing a second temperature sensing means 31 which is disposed in the discharge plenum 29 such that it is exposed to the incoming room air during periods of reverse convective air flow. In the illustrated embodiment, the sensing means 31 is mounted on the top wall 32 of control housing 20, as best seen in FIG. 1. The second temperature sensing means 31 is employed to re-energize evaporator fan 13 when the temperature of the room air reaches a predetermined level.

FIG. 3 illustrates a preferred embodiment of the manner in which switches operated by the temperature responsive devices 21 and 31 may be configured to provide improved operation of the air conditioner. Power lines L1 and L2 provide an AC source of power for the circuit. Compressor motor 18 is connected to the AC power source by a series connection of a single-pole, single-throw main power switch 33 and a single-pole, single-throw switch 34 which is operated by the temperature sensing means 21. Temperature sensing means 21 and the associated switch 34 comprise a thermostat such as are conventionally employed in air conditioners, and may comprise a liquid or gas filled sensing bulb 21*a* connected to a bellows element 21*b* which is adapted to move the contact of switch 34. Other types of thermostatic devices, such as a conventional bimetallic device, may alternatively be employed as the temperature sensing means 21.

Fan motor 16 is connected to the AC power source by means of a single-pole, double-throw switch 35 which is responsive to the temperature sensed by temperature sensing means 31. Switch 35 operates to connect fan 16 to the power source in parellel with switch 34 for temperatures above a predetermined level and to connect fan 16 to the power source in series with switch 34 for sensed temperatures below a predetermined level. By way of example, the temperature sensing means 31 and associated switch 35 may comprise a conventional bimetallic thermostat of the exposed disk type, and may be calibrated to connect the fan 16 in parallel with switch 34 for temperatures above 75° F.

Referring to FIG. 3, the operation of the control circuit is as follows. Assuming that the power switch 33 is closed and that the temperature of the room air is sufficiently high that sensing means 21 closes switch 34 to energize compressor motor 18, it can be seen that the evaporator fan motor 16 will also be energized regardless of the position of the contacts of switch 35. During operation of fan 13, the temperature sensing means 31 is exposed to the cold air being discharged from the air conditioner by way of the discharge plenum 29. This will cause the contacts of switch 35 to assume the position shown in FIG. 3, wherein fan motor 16 is connected to the source of power in series with switch 34. Hence, when the room air has cooled sufficiently such that temperature sensing means 21 causes switch 34 to open, both the compressor motor 18 and the fan motor 16 will be de-energized. Following de-energization of fan 13, a reverse convective air flow will be established through the evaporator housing 27 of the air conditioner, thus exposing sensing means 31 to incoming room air. If the temperature of the room air increases sufficiently, temperature sensing means 31 will operate switch 35 to connect fan 16 to the power source in parallel with switch 34. Thus, unless the main power switch 33 has been opened by the user, fan motor 16 will then be connected to the power source regardless of the position of switch 34. Energization of motor 16 will operate fan 13 to terminate the reverse convective air flow and draw room air over the temperature sensing means 21, thereby allowing temperature sensing means 21 to respond to the actual room air temperature. If the temperature of the room air has risen sufficiently to cause sensing means 21 to close switch 34, compressor motor 18 will again be energized otherwise, the fan motor 16 will operate alone until such time as the room air temperature either increases sufficiently to energize the compressor motor 18 or decreases sufficiently to de-energize the fan motor 16.

In the preferred embodiment, temperature sensing means 31 operates to connect motor 16 in parallel with switch 34 at a temperature several degrees below that at which sensing means 21 closes switch 34, thus energizing fan 13 to circulate room air over sensing means 21 before the room air reaches the temperature at which the air conditioner should be operating. This relationship between the sensing temperatures ensures that the air conditioner will be energized when the room air reaches the temperature at which further cooling is desired, thereby alleviating problems causes by the fact that the temperature response of conventional thermostatic controls generally lags the temperature of the air flowing over the device. By way of example, satisfactory operation results when the user-operated temperature sensing means 21 is set to energize the compressor 18 at 80° F. and the temperature responsive means 31 is arranged to energize fan 16 at 75° F. by connecting the fan to the power source in parallel with switch 34.

Thus, with the additional sensing means and control circuit of the present invention the reverse convective air flow phenomenon is utilized to advantage in providing cycled operation of the evaporator fan 13 while yet permitting re-energization of the fan as the room air approaches the temperature at which further cooling is required.

Various modifications of the preferred embodiment disclosed may be made without departing from the spirit of the invention. For example, the second sensing means 31 may be mounted elsewhere in the evaporator air flow circuit as long as it is subjected to incoming room air during periods of reverse convective air flow and is further subjected to discharge air when the evaporator fan is operating. In addition, the invention can be practiced with various types of thermally responsive switches because it is not necessary to employ a bulb type thermostatic device for sensing means 21 nor necessary to employ a bimetallic type sensing device for sensing means 31.

The present invention provides several advantages over prior art control systems. The only additional component required is a simple, inexpensive temperature responsive switch, and since this switch conducts only the current for the fan motor, it need not be capable of handling the high current level which the compressor motor requires. The type and location of the main thermostat need not be changed to practice the invention. Finally, if the switch 35 fails in either position, the air conditioner is still operational.

The foregoing disclosure of a preferred embodiment is illustrative of the broad inventive concepts comprehended by the invention.

I claim:

1. In an air conditioning apparatus including an evaporator, a compressor, air circulating means for circulating room air in heat transfer association with said evaporator, and first temperature responsive means for controlling the operation of said compressor, improved control means for said air circulating means comprising:

second temperature responsive means operative at temperatures above a predetermined temperature below the temperature at which said first temperature responsive means operates to energize said compressor to energize said air circulating means independent of the operation of said first temperature responsive means and further operative at a temperature below said predetermined temperature to energize said air circulating means only during energization of said compressor by said first temperature responsive means.

2. In an air conditioning apparatus including an evaporator, a compressor, air circulating means for causing room air to flow in heat transfer association with said evaporator, a source of electrical power and first temperature responsive means operative at temperatures above a first predetermined temperature to connect said power source to said compressor, improved control means for said air circulating means comprising:

second temperature responsive means operative at a second predetermined temperature which is below said first predetermined temperature to connect said air circulating means to said power source in parallel with said first temperature responsive means for temperatures above said second predetermined temperature and further operative to connect said air circulating means to said power source in series with said first temperature responsive means at a temperature below said second predetermined temperature.

3. The air conditioning apparatus of claim 2 wherein during periods of operation of said air circulating means said first temperature responsive means is responsive to the temperature of air entering said evaporator and said second temperature responsive switch is responsive to air leaving said evaporator.

4. The air conditioning apparatus of claim 2 wherein said evaporator has inlet and outlet portions, said first temperature responsive means being disposed in said inlet portion and said second temperature responsive means being disposed in said outlet portion.

5. The air conditioning apparatus of claim 2 wherein said second temperature responsive means is arranged to be responsive to the temperature of room air when said air circulating means is not energized.

6. The air conditioning apparatus of claim 5 wherein said second temperature responsive means is responsive to the temperature of air being discharged from said apparatus when said air circulating means is energized.

7. In an air conditioning apparatus including an evaporator, a compressor, air circulating means for circulating room air in heat transfer association with said evaporator, and first temperature responsive means for controlling the operation of said compressor, improved means for controlling said air circulating means comprising:

housing means for said evaporator arranged to establish a reverse convective flow of room air through said housing during periods when said compressor has been cycled off; and second temperature responsive means arranged to be exposed to room air entering said housing before the air flows in contact with said evaporator during periods of reverse convective air flow and operative above a predetermined temperature to energize said air circulating means.

8. The air conditioning apparatus of claim 7 wherein said second temperature responsive means operates to energize said air circulating means independent of the operation of said first temperature responsive means for temperatures above said predetermined temperature and further operates at a sensed temperature below said predetermined temperature to energize said air circulating means only when said compressor is energized by said first temperature responsive means.

9. The air conditioning apparatus of claim 7 wherein said housing means defines a generally vertical flow path and wherein energization of said air circulating means causes air to circulate upwardly through said flow path.

10. The air conditioning apparatus of claim 7 wherein said housing includes an air inlet portion and an air outlet portion disposed above said inlet portion.

11. The air conditioning apparatus of claim 10 wherein said first temperature responsive means is responsive to the temperature of air flowing through said inlet portion and said second temperature responsive means is responsive to the temperature of air flowing through said outlet portion.

* * * * *